US010707569B2

(12) United States Patent
Yen

(10) Patent No.: US 10,707,569 B2
(45) Date of Patent: Jul. 7, 2020

(54) WIRELESS TRANSMISSION EXPANSION DEVICE

(71) Applicant: Getac Technology Corporation, Hsinchu County (TW)

(72) Inventor: Li-Chuan Yen, Taipei (TW)

(73) Assignee: GETAC TECHNOLOGY CORPORATION, Hsinchu County (TW)

( * ) Notice: Subject to any disclaimer, the term of this patent is extended or adjusted under 35 U.S.C. 154(b) by 108 days.

(21) Appl. No.: 16/167,881

(22) Filed: Oct. 23, 2018

(65) Prior Publication Data

US 2020/0127372 A1 Apr. 23, 2020

(51) Int. Cl.

| | |
|---|---|
| ***H01Q 1/42*** | (2006.01) |
| ***H01Q 1/24*** | (2006.01) |
| ***H01Q 1/10*** | (2006.01) |
| ***H01Q 1/38*** | (2006.01) |

(52) U.S. Cl.
CPC ..... *H01Q 1/42* (2013.01); *H01Q 1/103* (2013.01); *H01Q 1/243* (2013.01); *H01Q 1/38* (2013.01)

(58) Field of Classification Search
CPC ..... H01Q 1/42; H01Q 1/103; H01Q 1/243; H01Q 1/38
See application file for complete search history.

*Primary Examiner* — Graham P Smith
(74) *Attorney, Agent, or Firm* — Locke Lord LLP; Tim Tingkang Xia, Esq.

(57) ABSTRACT

A wireless transmission expansion device includes: an expansion unit having a bottom base portion, the bottom base portion having therein a receiving space, wherein each of two sides of the bottom base portion extends to form a positioning clamping arm, and the two positioning clamping arms define therebetween a clamping space; a wireless transmission device disposed in the receiving space; and at least one antenna module disposed at the positioning clamping arms and being in signal connection with the wireless transmission device. Therefore, the wireless transmission expansion device operates in conjunction with an existing video apparatus or portable camera not capable of 4G transmission or not having internal storage space required for 4G transmission, so as to instantly transmit a large amount of video information.

12 Claims, 6 Drawing Sheets

WIRELESS TRANSMISSION EXPANSION DEVICE

BACKGROUND OF THE INVENTION

Field of the Invention

The present disclosure relates to expansion devices and, more particularly, to a wireless transmission expansion device capable of operating easily together with a portable video apparatus to carry out wireless transmission of video information.

Description of the Prior Art

Owing to scientific advancement and development, people's daily life is becoming smarter and more convenient. In this regard, conventional portable video apparatuses (computer, communication and consumer electronics) bring convenience to people at leisure or at work. The portable video apparatuses are capable of shooting films recording sounds, and taking pictures; video information thus obtained is stored in the apparatuses and thereafter retrieved or sent at an appropriate moment. However, the video information is so abundant that storage space runs out soon. In view of this, modern portable video apparatuses are capable of wireless transmission to thereby transmit the obtained video information to external apparatuses (or cloud) instantly by wireless transmission; hence, not only is storage space in the modern portable video apparatuses not occupied, but the obtained video information is also transmitted instantly.

Furthermore, the aforesaid portable video apparatuses are not only for use in leisure and recreation but are also for use in collection of evidence by police officers on duty. For instance, to avoid disputes, police officers wear portable cameras (video apparatuses) for recording the entire process of policing. The portable cameras (video apparatuses) are each clamped or hung on a police officer's uniform. At the end of his or her shift, the police officer retrieves images from the portable camera to serve as evidence of policing.

Not all existing video apparatuses are capable of 4G communication and transmission. WiFi communication and transmission facilities are not perfect in some areas. As a result, functions of the existing video apparatuses are restricted by the aforesaid factors, and thus sometimes the existing video apparatuses fail to transmit images instantly. Furthermore, at the present moment, compatible wireless transmission expansion devices are unavailable. For all the above reasons, enforcement of related policies and regulations is at stake. Therefore, it is important to overcome the aforesaid drawbacks of the prior art.

The inventor of the present disclosure notes that conventional wireless transmission expansion technology fails to cope with the aforesaid drawbacks and structural defects of the existing portable cameras and video apparatuses. Hence, the inventor of the present disclosure looked for a solution to the aforesaid drawbacks and structural defects. Eventually, the inventor of the present disclosure puts forth a wireless transmission expansion device which is not only good at communication and transmission of video data and images but is also highly compatible and cost-effective.

SUMMARY OF THE INVENTION

An objective of the present disclosure is to provide a wireless transmission expansion device operating in conjunction with an existing video apparatus or portable camera not capable of 4G transmission or not having internal storage space required for 4G transmission, so as to instantly transmit a large amount of video information.

Another objective of the present disclosure is to provide a wireless transmission expansion device which does not interfere with intrinsic functions of the aforesaid video apparatus or portable camera and thus is not only good at communication and transmission of video data and images but is also highly compatible and cost-effective.

In order to achieve the above and other objectives, the present disclosure provides, in an embodiment thereof, a wireless transmission expansion device including: an expansion unit having a bottom base portion, the bottom base portion having therein a receiving space, wherein each of two sides of the bottom base portion extends to form a positioning clamping arm, and the two positioning clamping arms define therebetween a clamping space; a wireless transmission device disposed in the receiving space; and at least one antenna module disposed at the positioning clamping arms and being in signal connection with the wireless transmission device.

DETAILED DESCRIPTION OF THE EMBODIMENTS

To enable persons skilled in the art to gain insight into features and achievable advantages of the present disclosure, the present disclosure is hereunder illustrated by embodiments and described below.

The present disclosure improves on conventional wireless transmission expansion devices and overcome drawbacks of the prior art, namely mainstream portable cameras and video apparatuses are incapable of 4G transmission and lack appropriate internal space for accommodating 4G modules capable of 4G transmission.

Figure 1:
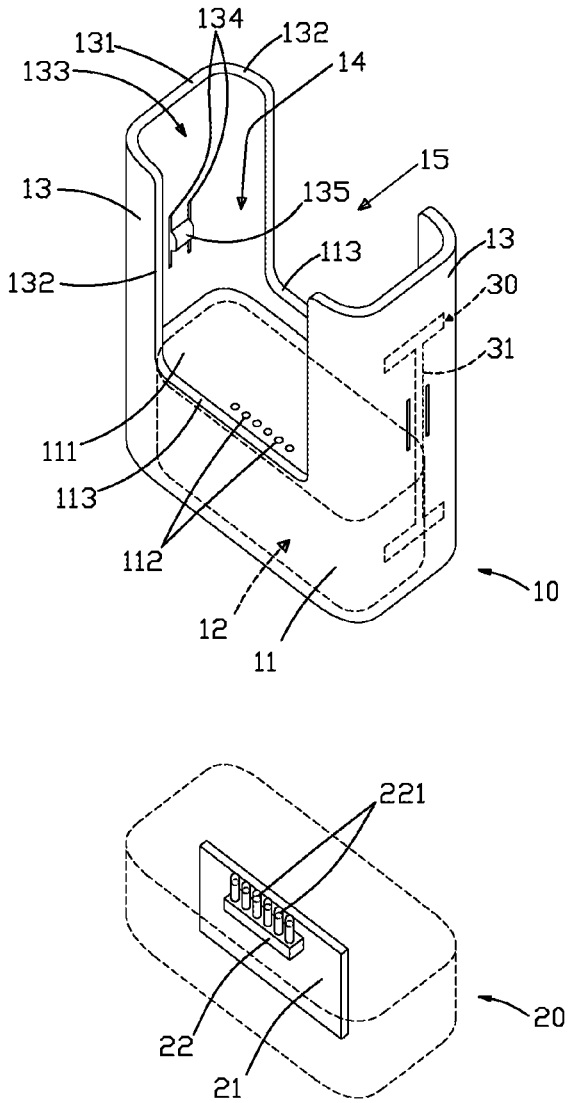
FIG. 1 is an exploded view of a wireless transmission expansion device according to an embodiment of the present disclosure.
Figure 2:
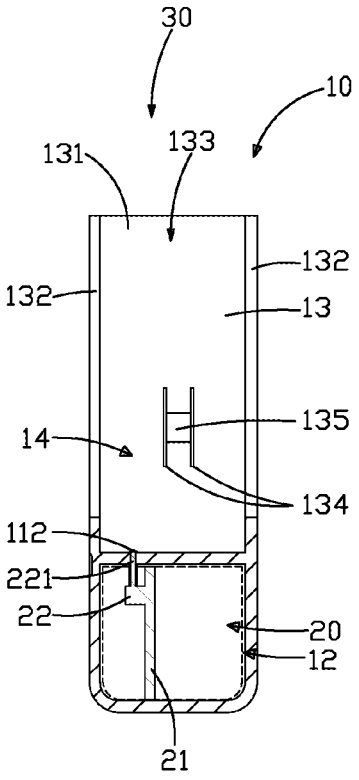
FIG. 2 is a cross-sectional view of the wireless transmission expansion device according to the embodiment of the present disclosure.

Referring to FIG. 1 and FIG. 2, the present disclosure provides, in an embodiment thereof, a wireless transmission expansion device including an expansion unit 10, a wireless transmission device 20 and at least one antenna module 30. The expansion unit 10 has a bottom base portion 11. The bottom base portion 11 has therein a receiving space 12. Each of the two sides of the bottom base portion 11 extends to form a positioning clamping arm 13. The positioning clamping arms 13 define therebetween a clamping space 14. The wireless transmission device 20 is disposed in the receiving space 12 to serve as a related electronic apparatus for use by the wireless transmission expansion device. The antenna module 30 is disposed at the positioning clamping arms 13. The antenna module 30 is in signal connection with the wireless transmission device 20.

In this embodiment, the bottom base portion 11 has a mounting surface 111 facing the clamping space 14, and thus the expansion unit 10 has the mounting surface 111 below the clamping space 14. The mounting surface 111 has a plurality of guide connection through-holes 112. The guide connection through-holes 112 are in communication with the receiving space 12. The expansion unit 10 has two protruding panels 113 on the front side and the back side, respectively. The protruding panels 113 are slightly higher than the mounting surface 111, and thus the protruding panels 113 and the positioning clamping arms 13 define the clamping space 14.

The positioning clamping arms 13 each further includes a clamping arm main portion 131. Each of the two sides of each clamping arm main portion 131 bends inward and extends to form a clamping arm lateral portion 132. The bottom of each clamping arm lateral portion 132 connects to the protruding panels 113. The clamping arm main portions 131 and the clamping arm lateral portions 132 are each substantially U-shaped to form an insertion slide opening 133.

In a preferred embodiment, the positioning clamping arms 13 (clamping arm main portions 131) each further have two vertical penetrating grooves 134. The inner side of the positioning clamping arm 13 forms an inward-protruding engaging element 135 between the two penetrating grooves 134. As shown in the diagrams, the engaging element 135 is an arcuate protruding block or any other block. The two penetrating grooves 134 together form a resilient region (not denoted with any reference numeral). The resilient region accommodates the engaging element 135. Hence, the positioning clamping arms 13 are appropriately resilient both entirely and partially (central engagement); hence, the wireless transmission expansion device is easy to use and safe.

An operating penetrating portion 15 is formed above the protruding panels 113 disposed on the front side and the back side of the expansion unit 10. The operating penetrating portion 15 is in communication with the clamping space 14 and thus penetrates the front side and the back side of the expansion unit 10. Hence, the clamping space 14 has the operating penetrating portion 15 disposed between the two positioning clamping arms 13 or centrally-located so that an external video apparatus placed therein has its front and back sides exposed or not hidden, thereby not interfering with performance of related functions of the external video apparatus and its body.

The wireless transmission device 20 includes a circuit board 21 which related electronic components and modules are mounted on or electrically connected to. For instance, the circuit board 21 is electrically connected to a wireless communication module (not shown). The wireless communication module receives and transmits related wireless signals enabled by Bluetooth, WiFi, 3G, 3.5G, 4G, 5G, FM, AM or PM. The circuit board 21 has an electrical connector 22. The electrical connector 22 includes a plurality of guide connection end pins 221. When the wireless transmission device 20 is disposed in the receiving space 12, the guide connection end pins 221 are inserted into the guide connection through-holes 112 in such a manner to allow the ends of the guide connection end pins 221 to protrude slightly from the guide connection through-holes 112, so as to facilitate reception of telecommunication signals. In another embodiment, the guide connection end pins 221 are appropriately resilient and thus capable of generating a resilient force under which the guide connection end pins 221 are not only compressed but also protrude and thrust toward the clamping space 14.

The antenna module 30 is disposed at the positioning clamping arms 13. The antenna module 30 is in signal connection with the wireless transmission device 20. As shown in FIG. 1, the antenna module 30 is an etched antenna 31, but the present disclosure is not limited thereto.

Figure 3:
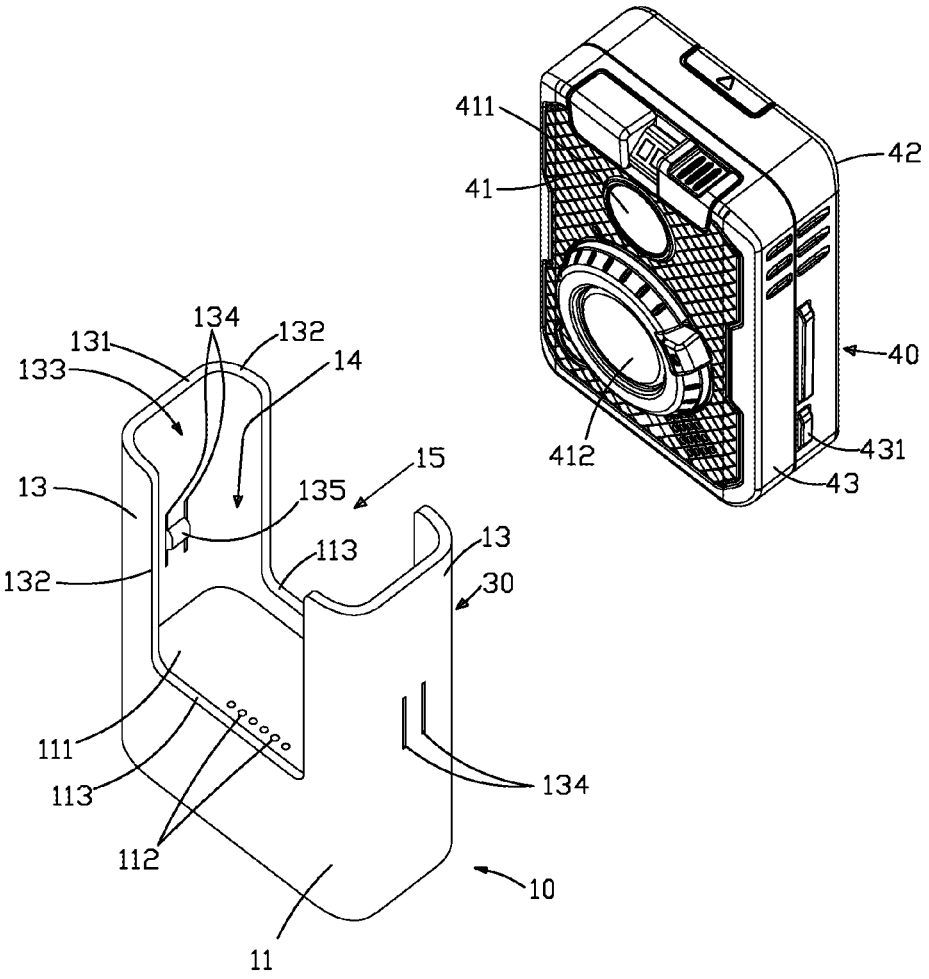
FIG. 3 is an exploded view of the wireless transmission expansion device according to the embodiment of the present disclosure.
Figure 4:
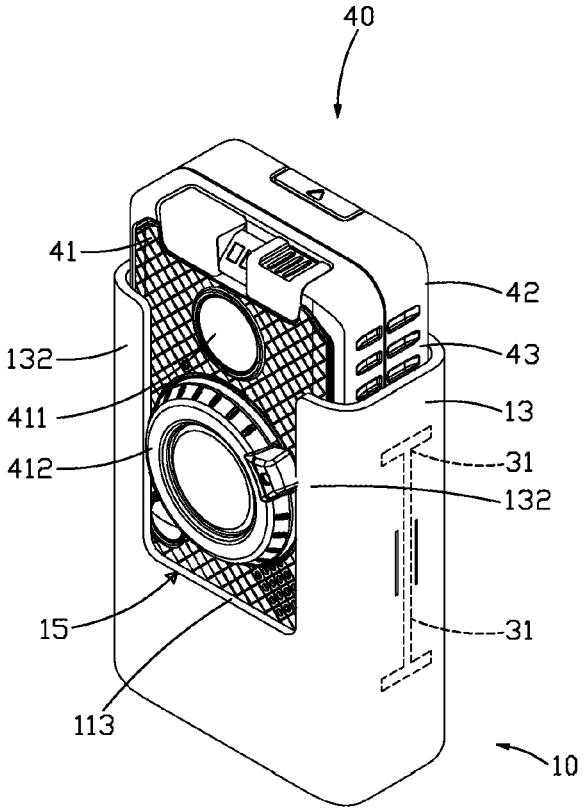
FIG. 4 is a perspective view of the wireless transmission expansion device according to the embodiment of the present disclosure.
Figure 5:
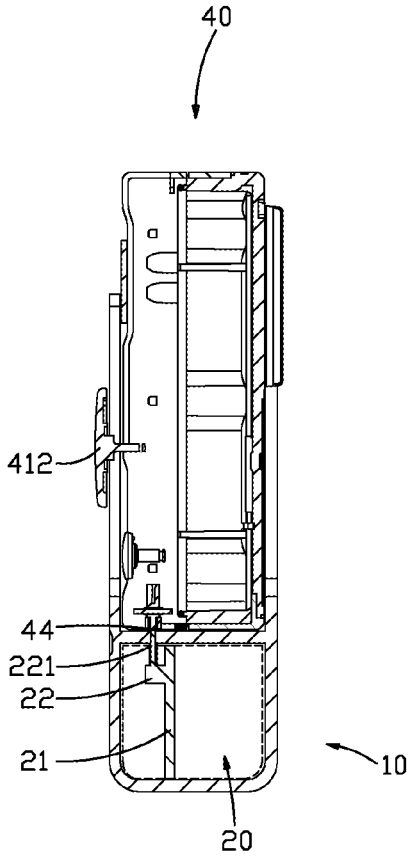
FIG. 5 is a cross-sectional view of the wireless transmission expansion device according to the embodiment of the present disclosure.

Referring to FIG. 3 through FIG. 5, which depict the operation of the wireless transmission expansion device of the present disclosure. As shown in the diagrams, a portable video device 40 has a body. The body has a body front side 41, a body back side 42 and two body lateral sides 43. The body front side 41 has a photographic lens 411 and a knob 412. The body lateral sides 43 each have a protruding element 431. The protruding element 431 is a key or an engaging element, but the present disclosure is not limited thereto. Furthermore, a related video apparatus component is disposed on the body, and a plurality of conductive portions 44 (shown in FIG. 5) is disposed at the bottom of the body.

To start using the wireless transmission expansion device of the present disclosure, a user inserts the video device 40 into the clamping space 14 of the expansion unit 10 such that the body lateral sides 43 of the video device 40 slide inward along the insertion slide opening 133 of the positioning clamping arms 13. After the video device 40 has been fully placed in the clamping space 14, the conductive portions 44 at the bottom of the video device 40 become electrically connected to the guide connection end pins 221, thereby achieving the electrical connection of the video device 40 and the wireless transmission device 20, as shown in FIG. 5.

Figure 6:
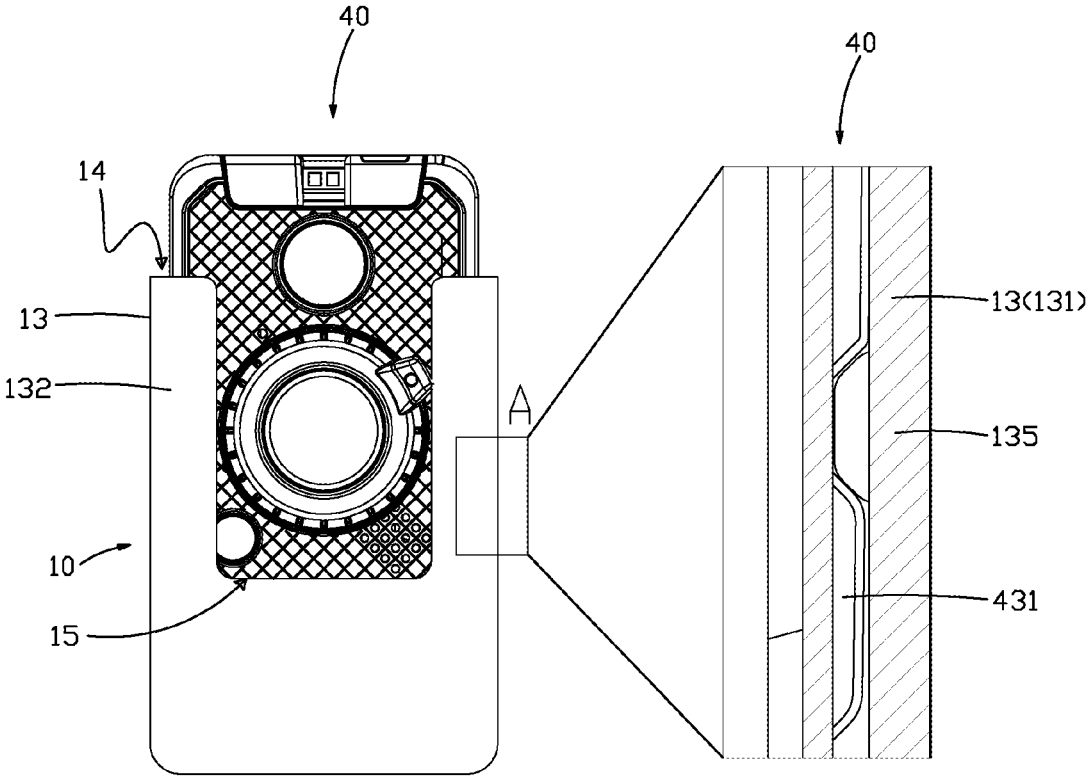
FIG. 6 is a front view of the wireless transmission expansion device according to the embodiment of the present disclosure.

As shown in FIG. 6, when the video device 40 is inserted into the clamping space 14 of the expansion unit 10, the body lateral sides 43 of the video device 40 slide inward along the insertion slide opening 133 of the positioning clamping arms 13. Since the body lateral sides 43 of the video device 40 have the protruding elements 431, such as keys or engaging elements, the protruding elements 431 slide and cross the engaging elements 135 on the inner sides of the positioning clamping arms 13 (clamping arm main portions 131). After the video device 40 has been fully placed in the clamping space 14, the engaging elements 135 abut against the protruding elements 431 such that the video device 40 is optimally positioned in place; hence, the video device 40 cannot escape from the clamping space 14 of the expansion unit 10. Since the engaging element 135 is disposed between the two penetrating grooves 134, the engaging element 135 can stretch outward resiliently; hence, the user may push the engaging element 135 gently in order to insert the video device 40 into the clamping space 14 smoothly, without interfering with an insertion operation while the wireless transmission expansion device is in use.

In conclusion, the wireless transmission expansion device in the aforesaid embodiments of the present disclosure operates in conjunction with an existing video apparatus or portable camera not capable of 4G transmission or not having internal storage space required for 4G transmission, so as to instantly transmit a large amount of video information.

The above preferred embodiments are illustrative of the present disclosure rather than restrictive of the scope of implementation of the present disclosure. All equivalent variations and modifications made to the preferred embodiments without departing from the shapes, structures and features disclosed in the present disclosure and the spirit embodied in the present disclosure shall be deemed falling within the scope of the claims of the present disclosure.

What is claimed is:

1. A wireless transmission expansion device, comprising:

an expansion unit having a bottom base portion, the bottom base portion having therein a receiving space, wherein each of two sides of the bottom base portion extends to form a positioning clamping arm, and the two positioning clamping arms define therebetween a clamping space;

a wireless transmission device disposed in the receiving space; and at least one antenna module disposed at the positioning clamping arms and being in signal connection with the wireless transmission device.

2. The wireless transmission expansion device of claim 1, wherein the expansion unit has a mounting surface below the clamping space, and the mounting surface has a plurality of guide connection through-holes.

3. The wireless transmission expansion device of claim 1, wherein the wireless transmission device comprises a circuit board, and the circuit board is electrically connected to a wireless communication module.

4. The wireless transmission expansion device of claim 3, wherein the circuit board is electrically connected to a plurality of guide connection end pins for guided connection to an external video apparatus.

5. The wireless transmission expansion device of claim 3, wherein the wireless communication module is enabled by Bluetooth, WiFi, 3G, 3.5G, 4G, 5G, FM, AM or PM.

6. The wireless transmission expansion device of claim 1, wherein the antenna module is an etched antenna.

7. The wireless transmission expansion device of claim 1, wherein the positioning clamping arms each comprise a clamping arm main portion, and each of two sides of each said clamping arm main portion bends and extends to form a clamping arm lateral portion.

8. The wireless transmission expansion device of claim 7, wherein the positioning clamping arms each have two corresponding penetrating grooves for forming a resilient region.

9. The wireless transmission expansion device of claim 8, wherein an inner side of the positioning clamping arm forms an engaging element at the resilient region.

10. The wireless transmission expansion device of claim 9, wherein the engaging element is an arcuate protruding block.

11. The wireless transmission expansion device of claim 1, wherein the clamping space has the operating penetrating portion disposed between the two positioning clamping arms.

12. The wireless transmission expansion device of claim 2, wherein two protruding panels are disposed on a front side and a back side of the expansion unit, respectively, the protruding panels being higher than the mounting surface.

* * * * *